US005490944A

United States Patent [19]

Suazon

[11] Patent Number: 5,490,944

[45] Date of Patent: Feb. 13, 1996

[54] LIQUID FABRIC SOFTENER COMPOSITIONS

[75] Inventor: Lamberta B. Suazon, Ajax, Canada

[73] Assignee: Colgate-Palmolive Company, New York, N.Y.

[21] Appl. No.: 289,050

[22] Filed: Aug. 11, 1994

[51] Int. Cl.[6] ..... D06M 13/46

[52] U.S. Cl. ..... 252/8.8; 252/8.6

[58] Field of Search ..... 252/8.6, 8.8

[56] References Cited

U.S. PATENT DOCUMENTS

| | | | |
|---|---|---|---|
| 4,439,335 | 3/1984 | Burns | 252/8.75 |
| 4,447,343 | 5/1984 | May et al. | 252/8.75 |
| 4,569,800 | 2/1986 | Stanley et al. | 252/8.8 |
| 5,399,272 | 3/1995 | Swartley et al. | 252/8.8 |
| 5,409,621 | 4/1995 | Ellis et al. | 252/8.8 |

OTHER PUBLICATIONS

R. R. Egan, "Cationic Surface Active Agents As Fabric Softeners", J. Am. Oil Chemists' Soc. (Jan. 1978) pp. 118–121.

J. A. Ackerman, "How to Choose Cationics For Fabric Softeners", JAOCS, vol. 60 No. 6 (Jun. 1983) pp. 1166–1169.

*Primary Examiner*—Anthony Green

*Attorney, Agent, or Firm*—Bernard Lieberman; Robert C. Sullivan

[57] ABSTRACT

A clear, water-soluble fabric softening composition has been developed from a blend of a quaternary ammonium salt and an amido imidazolinium compound dissolved in water. The former may be an hydrogenated tallow 2-ethylhexyl ammonium methosulfate and the latter a methyl-1-alkyl-amidoethyl-2-alkylimidazolinium methyl sulfate. The composition preferably also contains a lower alkylene glycol, e.g. hexylene glycol for product clarity and has a pH of about to about 4 to about 8.

16 Claims, No Drawings

LIQUID FABRIC SOFTENER COMPOSITIONS

BACKGROUND OF THE INVENTION

1. Field of the Invention

This invention relates to liquid fabric softener compositions. More particularly it relates to clear, liquid fabric softener compositions that also impart static control with lower staining properties and enhanced shelf life.

2. Description of the Related Art

Fabric softener compositions have been employed in the past to render washed laundry articles softer to the touch and hence enhance wearer comfort. These compositions encompass solutions, emulsions and particulate or powder compositions, such as, paper strips or sheets impregnated with fabric softener compositions. Most commercial products have included quaternary ammonium salts, such as, dimethyl ditallowyl ammonium chloride with emulsions of such softeners being added to the rinse water in the washing machine to effect softening of the laundry. As a variation on the theme, emulsions or powder products containing fabric softeners have been added to the wash water along with a detergent or the detergent composition can have incorporated into it a fabric softening component to make a so-called "softergent". In still another variation, articles containing a fabric softening component, such as a quaternary ammonium salt, can be added to the automatic laundry drier, where during tumbling of the laundry in a heated atmosphere, the fabric softener is applied to the laundry by repeated contact, thereby softening the laundered fabrics.

Other components in fabric softening compositions have been suggested including such as, neoalkanamides, glyceryl esters, glycol esters, silicones, cationic-anionic complexes, bentonite clays, and the like.

U.S. Pat. No. 3,928,212 describes softening agents which are polyhydric alcohol esters.

U.S. Pat. No. 4,126,562 mentions aerythritol and pentaerythritol which may be reacted with higher alcohols to produce fabric softeners, and combinations of quaternary ammonium salts with nonionic alcohol esters of higher fatty acids.

U.S. Pat. No. 4,142,978 discloses sorbitan esters combined with phase modifying components, such as, alkyl sulfates on a dryer sheet for softening laundry while it is being tumble dried in an automatic laundry dryer.

U.S. Pat. No. 4,162,984 relates to a textile treatment emulsion of a water insoluble cationic fabric softener, that is preferably a quaternary ammonium salt or an alkylimidazolium salt with a water insoluble nonionic fabric softener that is preferably a fatty acid ester of a mono- or polyhydric alcohol and an aromatic mono- or dicarboxylic acid.

U.S. Pat. No. 4,214,038 discloses polyglycerol esters as softening agents.

U.S. Pat. No. 5,126,060 discloses and claims a fabric softening, aqueous emulsion which comprises a higher aliphatic acid ester of pentaerythritol and emulsifying agent free of quaternary ammonium fabric softeners for a clear, liquid, water-soluble fabric softening agent.

U.S. Pat. No. 4,569,800 discloses and claims the use of hydrogenated tallowyl 2-ethylhexyl dimethylammonium chloride as a fabric softening compound.

However these and other art compositions do not satisfy a commercial market demand for a clear, water-soluble, cationic fabric softener composition that also provides good static control, minimal staining and enhanced shelf life.

It is an object of this invention to provide clear, completely water-soluble cationic fabric softener compositions that also provide good static control.

It is another object to provide clear cationic fabric softener compositions that are soluble in solvents other than water.

It is still another object to provide clear cationic fabric softener compositions that exhibit enhanced color stability, shelf life and stain resistance.

Other objects will become apparent to those skilled in the art upon a further reading of the specification.

3. Summary of the Invention

The objects enumerated above have been satisfied by a clear, water-soluble composition comprising:

(A) about 3 to about 90% by weight of a blend of:

(1) a quaternary salt having the structure:

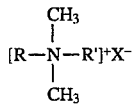

wherein R is the radical residuum of a mixture of saturated and unsaturated fatty acids having about 12 to about 18 carbon atoms, R' is an alkyl radical having about to about 12 carbon atoms, and X is a halide radical or $—SO_3CH_3$; with (2) an amido imidazolinium compound of the structure:

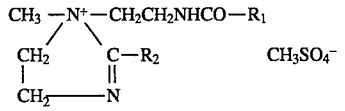

wherein $R_1$ and $R_2$ are each mixtures of the radical residua of saturated and unsaturated fatty acids having about 12 to about 18 carbon atoms; and (B) the remainder, water.

It is preferred to also include a solvent in the compositions of this invention. Suitable solvents include lower aliphatic alcohols, e.g., ethanol, isopropanol and the like or more preferably lower aliphatic glycols, e.g., ethylene glycol, propylene glycol, an hexylene glycol, either a straight chain one, viz. 1,6-hexanediol or 2,3-hexanediol or a branched chain one, viz. 2-methyl-2,4-pentanediol, 3-methyl-2,4,-pentanediol, 2,3-dimethyl-2,3-butanediol and the like. The presence of these monohydric or dihydric compounds has been found to improve the mutual solubility of the cationic components and hence the clarity of the total composition. The solvent level of the total composition may range from about 10 to about 40 weight percent. Optimum product clarity was achieved at a solvent level ratio of about 1:1 with the cationic fabric softening compounds.

These softener compositions may also contain various additives, as for example, perfumes or fragrances, colorants, bacteriostatic agents, and the like.

In a preferred embodiment of this invention, these softeners compositions also contain a stabilizing amount of a color stabilizer to enhance the shelf life of the product. Suitable color stabilizers include alkali metal bisulfites, such as, lithium, sodium or potassium bisulfites, and the like at a level of about 0.01 to about 0.5 weight percent of the total composition. Natural reducing agents can also be used, vizo, citric acid or ascorbic acid and the like. However, interaction with some fragrances may occur. If used, a preferred level is about 0.2 to about 2.0 percent of the total composition. As a caveat, it has been found that certain aromatic acid salts, such as, sodium benzoate are unacceptable due to the formation of a precipitate during aging thus shortening the shelf life of the softener compositions.

4. Description of the Invention

The quaternary salts of component (A) above can be prepared by condensing an aliphatic alcohol with a fatty acid amine, hydrogenating the resultant imine to a secondary amine, followed by methylation. The salt is determined by the nature of the methylating agent. Thus a methyl halide produces a quaternary halide and dimethyl sulfate produces a quaternary sulfate or methyl sulfate.

An economical source of fatty acids is available through the hydrolysis of naturally occurring fats. These include beef tallow, butter, coconut oil, corn oil, cottonseed oil, lard, corn oil, palm oil, palm kernel oil, soybean oil, and the like. Some quaternary salts are commercially, as for example, hydrogenated tallow octyldimonium methosulfate from Akzo Nobel Co.

The amido imidazolinium compounds may be prepared from the amido/amine resulting from the reaction of fatty acids or triglycerides with diethylene triamine followed by heating at a temperature of 350° to 450° F. (177° to 232° C.) to effect ring closure and then quaternizing with dimethyl sulfate as shown below:

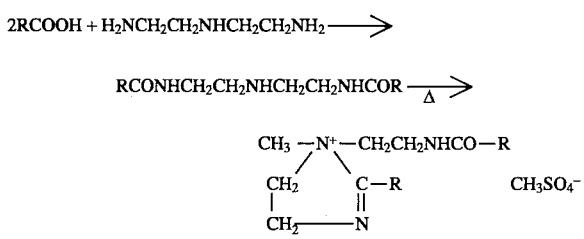

where R is as defined above.

This preparation is delineated in the papers by R. R. Egan, J. Am. Oil Chemists' Soc., January 1978 (Vol. 55) and J. A. Ackerman, JAOCS, Vol. 60, No. 6 (1983) incorporated herein by reference.

In order to achieve optimum clarity and static control together with product stability, these fabric softener compositions should have a pH of about 4 to about 8 with a preferred range of about 5 to about 6.

The invention is further described in the examples which follow. All parts and percentages are by weight unless otherwise specified.

METHODOLOGY OF WASHING AND DRYING

The same washer and dryer set were used throughout each replicate of the evaluations. All surfaces with which the test wash loads came in contact were wiped clean before use in order to remove any residual softeners from other evaluations. The steps followed for the washes are listed below.

1. Light bulk loads, virgin and non-virgin towels were standardized.

2. Washer was filled to capacity with water at 100° F. (49° C.).

3. 100 g of Tide detergent was added to the water as agitation started.

4. The light bulk load, two virgin towels and two non-virgin towels were added to the machine.

5. The machine was set for 10 minutes wash cycle with a single rinse. A second was started, at this point the liquid softener was added.

6. Upon completion of the wash, the contents of the washer were transferred to a dryer in the Humidity Controlled Room.

7. Each load was dried for 50 minutes.

8. Static control measurements were taken on the wash load.

9. A panel of 20 was used to evaluate the towels for softness.

EXAMPLE 1.

Preparation of Clear Liquid Fabric Softener Compositions

Into a glass mixing vessel, equipped with a mechanical stirrer was charged:

80.6274 parts of tap water 17.2059 parts of Arquad HTL8

2.1667 parts of Varisoft 3690

Upon mixing these ingredients, a clear solution was obtained. Arquad HTL8 is a hydrogenated tallow 2-ethylhexyl ammonium methosulfate commercially available from Akzo Nobel Chemicals. Varisoft 3690 is methyl alkyl amidoethyl imidazolinium methyl sulfate commercially available from Witco/Sherex.

A mixture of 96.1800 parts of Arquad HTL8 with 96.1800 parts of water had a water-like appearance and was clear. A mixture of 3.6000 parts of Varisoft 36909-75 had a white color and was opaque. The Arquad solution although clear did not provide sufficient fabric softening efficacy. The Varisoft composition while providing the required softening efficacy did not meet the goal of color and clarity.

It was then found that if 2 parts of hexylene glycol was blended with 15.2941 parts of Arquad HTL8 and 4.3333 parts of Varisoft 3690, a clear homogeneous liquid resulted. The hexylene glycol thus permitted an increase in the amount of Varisoft 3690 while maintaining the goal of clarity. However even 6 parts of hexylene glycol did not stabilize a mixture of 11.4706 parts of Arquad HTL8 and 8.6667 parts of Varisoft 3690, separation into two layers taking place.

EXAMPLE 2.

Formulation Color Stability

A clear fabric softening composition, having good storage stability was formulated from the following:

| | |
|---|---|
| Tap water | 70.8841 parts |
| Arquad HTL8 | 17.5059 " |
| Varisoft 3690 | 4.9600 " |
| Hexylene glycol | 6.0000 " |
| Sodium bisulfite | 0.0500 " |
| Captiva Claree | 0.6000 " |

Captiva Claree is a fragrance obtained from Givaudan-Roure.

EXAMPLE 3.

Fabric Softening and Static Control Evaluations

Static control results of the various fabric softening formulations were measured by two methods. First, instrumental readings which are voltmeter readings in millivolts and second, visual evaluations using a scale of 0 to 5 where 0 represents no detectable clinging of just-dried laundered towels. For fabric softening, 20 panelists were asked to rate the towels for subjective softness in a paired comparison. Frequency as the number 1 choice is the number of times out of 20 that a towel was judged to be softer.

A comparison was made of the three formulations shown below at a relative humidity of 44% and a temperature of 70° F. (21° C.).

| Material | #1 | #2 | #3 |
|---|---|---|---|
| Arquad HTL8 | 19.1177 | 15.2941 | — |
| Varisoft 3690 | — | 4.3333 | 21.6667 |
| Hexylene glycol | — | 6.0000 | 21.6667 |
| Fragrance | 0.2000 | 0.2000 | 0.2000 |
| Water | 80.6823 | 74.1725 | 56.4666 |

The static control evaluation of the three formulations by instrumental and visual means is shown below.

| Instrumental in mv | | | Visual Evaluation | | |
|---|---|---|---|---|---|
| #1 | #2 | #3 | #1 | #2 | #3 |
| 9529 | 4014 | 2300 | 2.5 | 1.0 | 0.5 |

Softness evaluation results of the three formulations are shown below.

| Freguency as Number 1 | | |
|---|---|---|
| #1 | #2 | #3 |
| 10 | 10 | 14 |

The mixture of Arquad HTL8 and Varisoft 3690 showed better static control than the former but less than the latter. In the softness efficacy tests, the mixture and the former were comparable but less than the latter. However bearing in mind that the objective sought for is a combination of water clarity together with both softness and static control, only the claimed blend meets these specifications of commercial acceptance.

4. Staining Evaluation of Fabric Softening Composition

A staining evaluation of the fabric softening composition delineated in Example 2 was conducted against three commercial fabric softening products, viz,. Fresh Fragrance Fleecy, Ultra Downy April Fresh and Cuddle Up Fresh Snuggle. The following fabrics were used as substrates:

65/35 Cotton/polyester—White, yellow, green, blue, red

100% Cotton—White, yellow, green, blue, red

100% Polyester—White, yellow green, blue, red

100% Nylon—White, green, blue

100% Acetate—White, green, blue, red

100% Rayon—Yellow, green, blue, red

The fabrics were standardized by conducting two consecutive warm washes in Tide at 100° F. (38° C.) and a single warm water wash. The washed fabrics were dried in the automatic dryer for 1 hour. The fabrics were cut into 4"×4" swatches and were labelled for identification. The test products were applied to each swatch in 1 ml quantities using a burette. A piece of wax paper was placed under each swatch to safeguard against cross contamination between products. The treated set swatches were allowed to sit for an hour. The swatches were put through a cold rinse cycle with standardized hand towels. The swatches were dried in an automatic dryer for 50 minutes.

The swatches were evaluated visually by six expert judges under controlled lighting conditions in a Macbeth lightbox-(cool white fluorescent). The expert judges were asked to utilize the following rating scale.

0—No stain

1—Think a little stain is present

2—Sure a little stain is present

3—Sure a moderate stain is present

4—Sure a significant stain is present

The average scores for the different fabrics recorded by six expert judges established that the claimed composition exhibited a significantly lower staining potential than the three commercial fabric softeners. The claimed composition showed no staining on 5 out of the 6 fabrics tested and minimal staining on 100% cotton. In contrast, all three of the commercial fabric softeners showed significant staining on all of the fabrics tested.

Although the invention has been described with a certain amount of particularity, it is understood that the present disclosure of the preferred forms has been made only by way of example and that numerous changes and modifications can be resorted to without departing from the spirit or scope of the invention.

What is claimed is:

1. A clear, water-soluble fabric softening composition consisting essentially of:

(A) about 3 to about 90% by weight of a blend of:

(1) a quaternary ammonium salt having the structure:

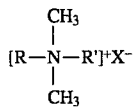

wherein R is the radical residuum of a mixture of saturated and unsaturated fatty acids having about 12 to about 18 carbon atoms, R' is an alkyl radical having about 2 to about 12 carbon atoms, and X is a halide radical or $—SO_3CH_3$; with (2) an amido imidazolinium compound of the structure:

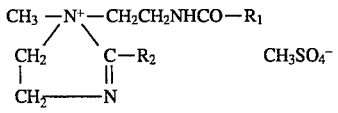

wherein $R_1$ and $R_2$ are each mixtures of the radical residua of saturated and unsaturated fatty acids having about 12 to about 18 carbon atoms, wherein the ratio of component (1) to component (2) is from abut 8:1 to about 3.6:1; and (B) water.

2. Composition claimed in claim 1 wherein about 2 to about 6 weight percent of a water-soluble alkylene glycol having about 2 to about 6 carbon atoms is present.

3. Composition claimed in claim 2 wherein the glycol is an hexylene glycol.

4. Composition claimed in claim 1 wherein R is an alkyl radical having about 18 carbon atoms and R' is an alkyl radical having about 8 carbon atoms.

5. Composition claimed in claim 1 wherein R is a mixture of alkyl radicals having about 75 percent with 18 carbon atoms and about 25 percent with 16 carbon atoms and R' is an 2-ethylhexyl radical.

6. Composition claimed in claim 1 wherein component (1) is a hydrogenated tallow 2-ethylhexyl ammonium methosulfate.

7. Composition claimed in claim 1 wherein component (2) is methyl alkyl amidoethyl imidazolinium methyl sulfate.

8. Composition claimed in claim 1 wherein the weight ratio of component (1) to component (2) is about 4:1.

9. Composition claimed in claim 1 wherein the weight of blend (A) is about 10 to about 40 percent of the total composition.

10. Composition claimed in claim 1 wherein the pH is about 4 to about 8.

11. Composition claimed in claim 1 wherein the pH is about 5 to about 6.

12. Composition claimed in claim 1 wherein a stabilizing amount of a color stabilizer is present.

13. Composition claimed in claim 12 wherein the stabilizer is an alkali metal bisulfite.

14. Composition claimed in claim 13 wherein the alkali metal bisulfite is sodium bisulfite.

15. Composition claimed in claim 12 wherein the alkali metal bisulfite concentration is about 0.01 to about 0.05% by weight of the total composition.

16. Composition claimed in claim 1 wherein a minimal amount of about 0.6% of a perfume or fragrance is present.

* * * * *